United States Patent [19]

Holden

[11] Patent Number: 4,953,603

[45] Date of Patent: Sep. 4, 1990

[54] TOWEL-PROTECTING COVER ASSEMBLY

[76] Inventor: Richard S. Holden, 1626 Hampton Rd., Abington, Pa. 19001

[21] Appl. No.: 404,598

[22] Filed: Sep. 8, 1989

[51] Int. Cl.[5] ..... A47K 10/12; A63B 47/04; A63B 57/00

[52] U.S. Cl. ..... 150/154; 15/209 R

[58] Field of Search ..... 150/154, 160; 15/209 R, 15/2; 206/812; 2/279; D 6/608

[56] References Cited

U.S. PATENT DOCUMENTS

| | | | |
|---|---|---|---|
| D. 189,286 | 11/1960 | Belleni | D 6/608 |
| D. 242,105 | 11/1976 | Rohrs | D 6/608 |
| 1,928,696 | 10/1933 | Lewis | 150/154 |
| 2,204,947 | 6/1940 | Apfelbaum | 2/279 X |
| 2,233,157 | 2/1941 | Cahn et al. | 2/279 X |
| 3,305,736 | 11/1967 | Frazelle et al. | 15/209 R X |
| 4,004,315 | 1/1977 | Rials | 15/209 R |
| 4,498,579 | 2/1985 | Brick | 150/159 X |
| 4,516,616 | 5/1985 | Fesler | 150/154 |
| 4,771,502 | 9/1988 | Trimble | 15/209 R |

FOREIGN PATENT DOCUMENTS

| | | | |
|---|---|---|---|
| 206334 | 11/1923 | United Kingdom | 15/209 R |

*Primary Examiner*—Sue A. Weaver
*Attorney, Agent, or Firm*—Larson & Taylor

[57] ABSTRACT

A towel-protective cover assembly is provided for use by golfers and the like. The assembly comprises a towel; an openable fastener connected to one edge of the towel and adapted to be releasibly secured to a ring support; and a protective cover comprising a bag fabricated of a plastic material which is at least water resistant. The bag is open at the bottom thereof and comprises four sides including a first pair of opposed sides having gussets formed therein at the top thereof which permits expansion of the bag and provides access to the towel. A second pair of opposed sides are sealed together at the top edges thereof to form a sealed upper edge portion and to seal together, to form lateral portions of the sealed upper edge, the top edges of respective inwardly extending portions of the first pair of sides and corresponding lateral portions of the top edges of the second pair of opposed sides to so as to thereby form the gussets in the first pair of opposed sides. The sealed upper edge has a central cutout opening therein through which a portion of the openable fastener extends.

4 Claims, 1 Drawing Sheet

TOWEL-PROTECTING COVER ASSEMBLY

FIELD OF THE INVENTION

The present invention relates to a towel-protector assembly for golfers and the like which maintains a towel in a dry, protected state under adverse weather conditions and which, more generally, protects the towel from moisture and soiling when the towel is not in use.

BACKGROUND OF THE INVENTION

In U.S. Pat. No. 4,516,616 (Fesler), there is disclosed portable towel accessory for protecting a towel from getting wet or soiled. As stated in that patent, there are many situations in which this is desirable, such as golfing, fishing, bowling, and working in a machine shop. For example, in golf it is difficult to keep a towel dry during a rainy period because of the exposed conditions on the golf course, and a dry towel is a considerable help to a golfer in that it enables him to dry his clubs, club handles or his hands.

The towel accessory device disclosed in the Fesler patent comprises a special protective cover made of a sheet of water-resistant or waterproof material, and an associated towel. Both the towel and cover include, in a preferred embodiment, a pair of holes through which an openable loop passes. The cover and towel are suspended from the loop so that they hang freely, with each assuming the shape of a pleated cone, and with the central portions of the towel and cover forming the apexes of the cones. This enables a user to use the towel by reaching upwardly under the cover. The cover and towel are connected together, e.g., by the loop, so that the positions of the two can be reversed, i.e., so that the cover can be draped over the towel or, alternatively, the towel can be draped over the cover.

There are a number of disadvantages associated with the portable towel accessory disclosed in the Fesler patent. For example, if the accessory is dropped or falls on damp or wet ground, the tendency of the device, because of its pleated cone configuration, is to spread out so that the towel can be soiled or get wet. Further, the need to resort to the awkward, cumbersome operation of threading the openable loop (chain or rope) through the two sets of holes before the device is ready to use is also a disadvantage. Further, although the portable towel accessory disclosed in the Fesler patent is relatively simple in construction as will appear, that construction is more complex than the towel-protective cover assembly of the invention.

SUMMARY OF THE INVENTION

In accordance with the present invention, a protective cover for a towel is provided which is extremely simple to make and use and which overcomes the problems and disadvantages of the prior art, including the disadvantages of the towel accessory of the Fesler patent discussed above.

According to a preferred embodiment thereof, the invention comprises a towel-protective cover assembly comprising a protective cover or sheath in the form of a four-sided bag made of a water-resistant or waterproof material, the bag including a pair of opposed flat sides which are sealed together along the top of the bag to form a top edge and an aperture or opening formed in the top edge. The bag is open at the bottom to provide access to the interior thereof and the other two opposed sides are gusseted to enable lateral spreading thereof to enable a user full access to the interior of the bag through the bottom. The assembly also comprises a towel including an openable spring fastener, which extends through the aperture in the top edge of the protective cover, for permitting the towel and cover to be suspended from a ring support or the like such as the support ring for the carrier strap of a golf bag.

The towel preferably includes an eyelet in the middle of one edge thereof and the spring fastener preferably includes a base portion which extends through the eyelet in the towel and a fastener portion integral with the base portion and including separable abutting ends which can be separated to permit the fastener to be attached to the support ring of the golf bag.

The towel-protective cover assembly of the prior art provides a number of important advantages. For example, the gusseted sides of the bag allow the bag to be readily expanded, thereby permitting the hands of a user to fit comfortably inside and thus allow drying of the hands of the user or of, e.g., a golf club handle. Further, although the bag is expandable by virtue of the gusseted sides, the bag is constructed so as to normally fit snugly around the towel so that the bag will protect the towel even if the assembly falls on the ground.

Other features and advantages of the invention will be set forth in, or apparent from, the detailed description of a preferred embodiment of the invention which follows.

BRIEF DESCRIPTION OF THE DRAWINGS

Figure 1:
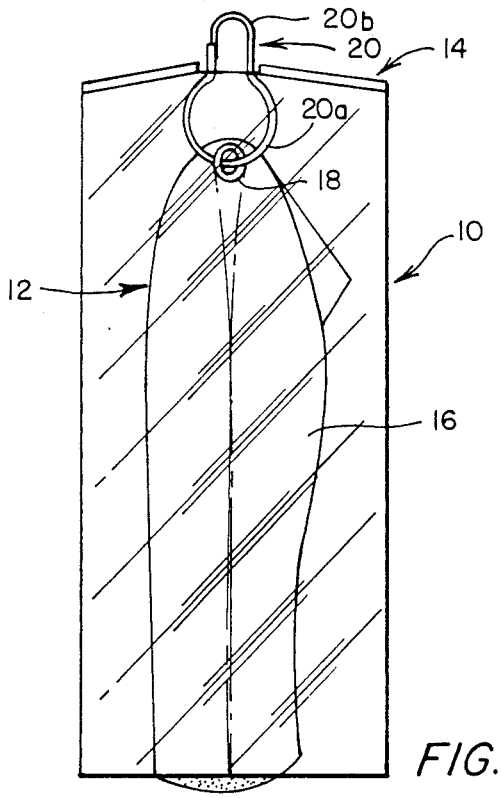
FIG. 1 is a side elevational view of the towel-protective cover assembly of the invention.

Referring to FIG. 1, the towel-protector assembly of the invention is shown. The assembly, which is generally denoted 10, comprises a towel device 12 and a protective cover or sheath 14 which covers the towel device 12.

Figure 2:
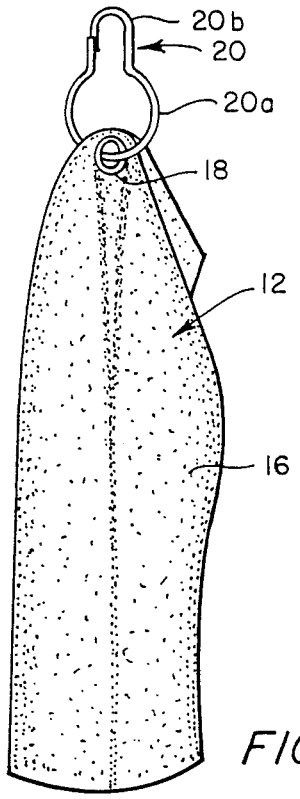
FIG. 2 is a side elevational view of the towel of the assembly of FIG. 1.

As shown in FIG. 2, the towel device 12 comprises a generally rectangular towel 16 having an eyelet 18 in the middle of the upper edge thereof and a spring or snap fastener 20 comprising a generally circular base portion **20*a* which extends through eyelet 18 and an upper snap portion 20*b*, including separable ends, which is adapted to be snapped onto a support ring on golf bag as described below in connection with FIG. 4**.

Figure 3:
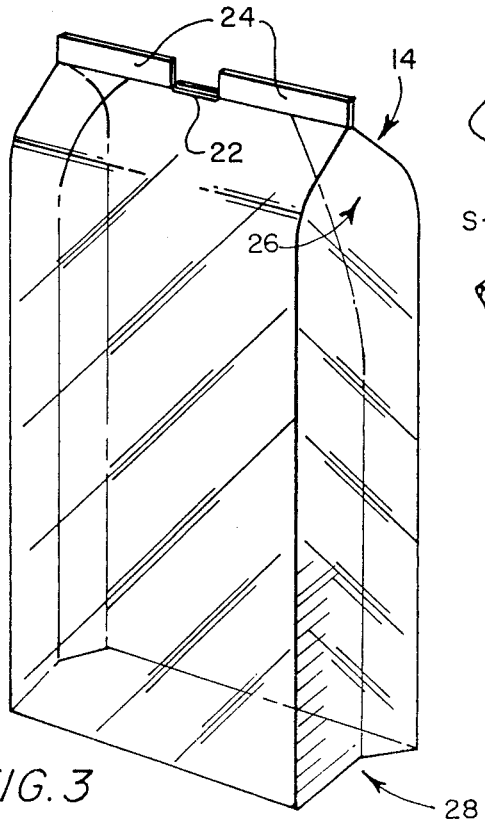
FIG. 3 is a perspective view of the protective cover of the assembly of FIG. 1.

Protective cover or sheath 14, which is best seen in FIG. 3, comprises a bag-like device fabricated of plastic or a like waterproof or water-resistant material and including a central opening 22 provided in the top edge 24 thereof. The snap hook hook or fastener 20 of towel device 12 extends through opening 22. The top edge 24 of sheath or cover 14 is provided by sealing the upper edges of two sides of the bag together, with gussets 26 being formed at the two other sides of the sheath 14. More specifically, the lower edges of sheath 14 are unsealed and provide a bottom opening 28 for the sheath 14, while inwardly extending portions of the two opposite sides of the bag are sealed together with lateral portions of the top edges of the other two opposed sides in forming the top edge 24. In this way, the gussets 26 are formed in the other two opposed sides of the protective cover 14 at the top of protective cover 14, as illustrated. It will be appreciated that the sides of the bag may not be distinct at the bottom of the bag, i.e., that the bag tends to "round out" at the bottom 28 away from gussets 26.

Figure 4:
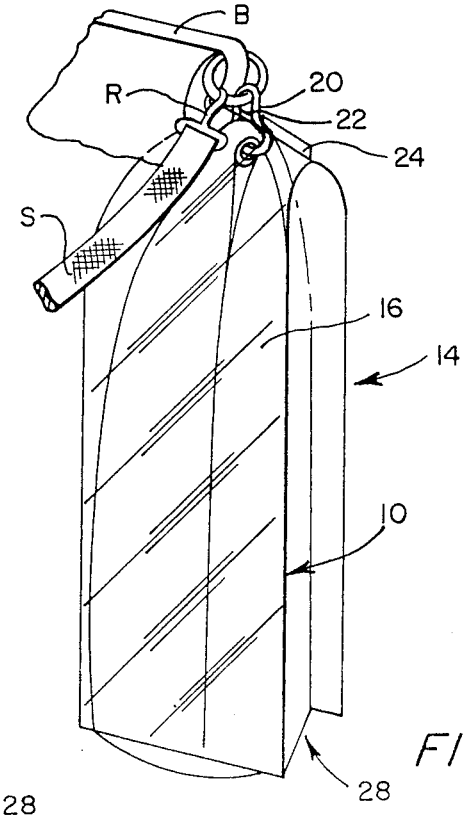
FIG. 4 is a perspective view of the towel-protective cover assembly of FIG. 1 suspended from the carrier strap support ring of a golf bag.

As shown in FIG. 4, the towel-protector device 10 is, in use, simply attached by means of snap hook or fastener 20 to the support ring R for the carrier strap S of a golf bag B so that device 10 hangs down therefrom. The open bottom 28 permits the user to readily slip his or her hands under the protective cover or sheath 14 to use the towel 16, and the gusseted sides of the protective cover 14 enable the user to spread the cover 14 laterally to the extent necessary to provide full use of the towel. It will be appreciated that the construction of the protective cover 14, including the gusseted sides, is simple yet is very effective to providing full protection for towel 16 while enabling the necessary access thereto by a user. While the towel 16 is shown extending slightly below protective sheath 14 in FIGS. 1 and 4, the sheath 14 preferably extends 1 to 2 inches below the enclosed towel 16 so as to prevent possible "wicking" of water into the towel and saturating it.

Although the present invention has been described relative to a specific exemplary embodiment thereof, it will be understood by those skilled in the art that variations and modifications can be effected in this exemplary embodiment without departing from the scope and spirit of the invention.

What is claimed is:

1. A towel-protective cover assembly comprising:

a towel;

an openable fastener means, connected to one edge of said towel, for releasably securing said towel to a ring support; and a protective cover comprising a bag fabricated of a plastic material which is at least water resistant; said bag being open at the bottom thereof and comprising four sides including a first pair of opposed sides having gussets formed therein at the top thereof, and a second pair of opposed sides which are sealed together at the top edges thereof to form a sealed upper edge portion and to seal together, to form lateral portions of said sealed upper edge, the top edges of respectively inwardly extending portions of said first pair of sides and corresponding lateral portions of said top edges of said second pair of opposed sides so as to thereby form said gussets in said first pair of opposed sides, said sealed upper edge having a central cutout opening therein through which a portion of sad openable fastener means extends.

2. A towel-protective cover assembly as claimed in claim 1 wherein said towel is rectangular in shape and includes an eyelet centrally located in said one edge thereof through which said fastener extends.

3. A towel-protective cover assembly as claimed in claim 1 wherein said fastener means comprises a spring fastener including a base part-circular portion and an integral upper portion including ends which are normally biassed together and which are separable to enable the fastener to be secured to the ring support.

4. A towel-protective cover assembly as claimed in claim 3, wherein, in use, the upper portion of said fastener extends through the cutout opening in said cover, and wherein the width of the upper portion is less than the width of said base portion, and the width of said cutout opening in said cover is greater than the width of said cutout opening in said cover is greater than the width of said upper portion and less than the width of said base portion.

* * * * *